US007334277B2

(12) United States Patent
Johnson

(10) Patent No.: US 7,334,277 B2
(45) Date of Patent: Feb. 26, 2008

(54) LOW PROFILE HOSPITAL BED

(75) Inventor: Michael Karl Johnson, Hays, KS (US)

(73) Assignee: Raye's, Inc., Ellis, KS (US)

( * ) Notice: Subject to any disclaimer, the term of this patent is extended or adjusted under 35 U.S.C. 154(b) by 0 days.

(21) Appl. No.: 11/351,459

(22) Filed: Feb. 10, 2006

(65) Prior Publication Data

US 2006/0123545 A1 Jun. 15, 2006

Related U.S. Application Data

(63) Continuation of application No. 10/823,907, filed on Apr. 14, 2004, now Pat. No. 7,013,510.

(51) Int. Cl.
*A61G 7/012* (2006.01)
*A61G 1/02* (2006.01)

(52) U.S. Cl. ..... 5/611; 5/86.1; 296/20

(58) Field of Classification Search ..... 5/611, 5/600, 11, 86.1, 83.1, 81.1 R; 296/20
See application file for complete search history.

(56) References Cited

U.S. PATENT DOCUMENTS

| | | | |
|---|---|---|---|
| 2,564,333 | A | 8/1951 | Kelly |
| 2,841,438 | A | 7/1958 | Weil |
| 2,877,047 | A | 3/1959 | Weil |
| 2,877,048 | A | 3/1959 | Weil |
| 2,889,561 | A | 6/1959 | Martin |
| 3,003,159 | A | 10/1961 | Hebert |
| 3,057,655 | A | 10/1962 | Weil |
| 3,088,770 | A | 5/1963 | Weil |
| 3,305,876 | A | 2/1967 | Hutt |
| 3,493,262 | A | 2/1970 | Ferneau |
| 3,802,002 | A | 4/1974 | Jonas |
| 3,826,528 | A | 7/1974 | East |
| 4,023,849 | A | 5/1977 | Bethlen |
| 4,192,541 | A | 3/1980 | Ferneau |
| 4,682,810 | A | 7/1987 | Zarka |
| 4,921,295 | A | 5/1990 | Stollenwerk |
| 5,015,024 | A | 5/1991 | Bloemer |
| 5,084,922 | A | 2/1992 | Louit |

(Continued)

FOREIGN PATENT DOCUMENTS

| | | |
|---|---|---|
| DE | 3631409 | 3/1988 |

(Continued)

*Primary Examiner*—Robert G. Santos
(74) *Attorney, Agent, or Firm*—Spencer Fane Britt & Browne

(57) ABSTRACT

A low profile hospital bed includes a mattress support frame and pivotably mounted wheel frames. Lift actuators connecting between the mattress support frame and the wheel frames move the wheel frames between a folded position and an unfolded position. When the wheel frames are in the folded position, the lift actuators are relatively horizontal and thus unable to provide enough vertical force to move the wheel frames. Accordingly, connecting between the actuators and the wheel frames are leverage members which rotate and urge the wheel frames away from mattress support frame during an initial, first stage of movement as the wheel frames partially unfold. After the first stage of movement, the leverage members function as simple mechanical links between the lift actuators and the wheel frames as the lift actuators continue to power the complete unfolding of the wheel frames.

19 Claims, 18 Drawing Sheets

U.S. PATENT DOCUMENTS

| | | | | |
|---|---|---|---|---|
| 5,432,966 | A | 7/1995 | Berta | |
| 5,509,159 | A | 4/1996 | Du-Bois | |
| 6,230,344 | B1 * | 5/2001 | Thompson et al. | 5/611 |
| 6,405,393 | B2 | 6/2002 | Megown | |
| 6,473,922 | B1 | 11/2002 | Sommerfeld | |
| 6,578,216 | B1 | 6/2003 | Aarestad | |
| 6,601,251 | B2 | 8/2003 | Paul | |
| 6,735,794 | B1 | 5/2004 | Way | |
| 6,880,202 | B2 | 4/2005 | Thompson | |
| 6,920,656 | B2 | 7/2005 | Roussy | |
| 6,941,600 | B2 | 9/2005 | Freeborn | |
| 6,976,696 | B2 * | 12/2005 | O'Krangley et al. | 280/640 |
| 7,003,828 | B2 * | 2/2006 | Roussy | 5/611 |
| 7,013,510 | B1 * | 3/2006 | Johnson | 5/611 |
| 7,134,155 | B2 * | 11/2006 | Freeborn et al. | 5/611 |
| 7,185,377 | B2 * | 3/2007 | Roussy | 5/611 |
| 2001/0047546 | A1 | 12/2001 | Megown | |
| 2003/0172459 | A1 | 9/2003 | Roussy | |
| 2004/0088792 | A1 | 5/2004 | O'Krangley | |
| 2004/0111798 | A1 | 6/2004 | Matunaga | |
| 2004/0128766 | A1 | 7/2004 | Freeborn | |
| 2005/0091747 | A1 | 5/2005 | Freeborn | |
| 2005/0283911 | A1 * | 12/2005 | Roussy | 5/611 |
| 2005/0283912 | A1 * | 12/2005 | Roussy | 5/611 |
| 2006/0123545 | A1 * | 6/2006 | Johnson | 5/611 |
| 2006/0207027 | A1 * | 9/2006 | Matunaga et al. | 5/611 |
| 2006/0225203 | A1 * | 10/2006 | Hosoya et al. | 5/86.1 |
| 2007/0083992 | A1 * | 4/2007 | Lindner et al. | 5/611 |
| 2007/0083993 | A1 * | 4/2007 | Lindner | 5/611 |

FOREIGN PATENT DOCUMENTS

| | | |
|---|---|---|
| DE | 2719781 | 1/1989 |
| DE | 3824118 | 1/1990 |
| GB | 2068301 | 8/1981 |

* cited by examiner

LOW PROFILE HOSPITAL BED

RELATED APPLICATIONS

The present application is a continuation and claims priority of an earlier-filed non-provisional patent application of the same title, Ser. No. 10/823,907, filed Apr. 14, 2004 now U.S. Pat. No. 7,013,510. The identified earlier-filed application is hereby incorporated by reference into the present application.

FIELD OF THE INVENTION

This invention relates to a low profile hospital bed.

BACKGROUND OF THE INVENTION

Some hospital patients have a tendency to roll out of a hospital bed. This presents a significant risk of injury. In the past, hospitals and other care facilities have used various types of restraints to secure such patients. However, patient restraints are no longer favored in the modern hospital environment. An alternate solution to this problem has been to employ a low profile bed thus locating the surface of the bed as close to the floor as possible. Yet, such a low profile bed must also be able to raise to a higher position so that doctors and nurses may have access to the patient. The arrangement of a very low profile bed typically places the actuators for raising and lowering the bed at a relatively shallow angle when the bed is in the lowered position. The actuator vertical force component available at such relatively shallow angles can become too small to lift the bed and the patient. This has limited the minimum height of mechanically actuated low profile hospital bed frames. What is needed is an arrangement which solves this problem and permits the design of a low profile hospital bed having a minimum height which is constrained not by actuator mechanics but by such considerations as the required thickness of frame members and wheel clearance.

SUMMARY OF THE INVENTION

In an embodiment of the present invention the aforementioned problem is addressed by providing a low profile hospital bed including a mattress support frame and wheel frames pivotably mounted to the mattress support frame which pivot between a folded position in which the mattress support frame is relatively close to the floor and a fully unfolded position in which the mattress support frame is at a maximum height above the floor. A leverage member for prying the wheel frame away from the mattress support frame is pivotably mounted to each wheel frame. Each leverage member is pivotably mounted to a wheel frame. A lift actuator connects between each leverage member and the mattress support frame. The leverage member is arranged to rotate relative to the wheel frame and push against the mattress support frame and thus pry the wheel frame away from the mattress support frame as the lift actuator begins extending from the its retracted position. The leverage member is also arranged to stop rotating relative to the wheel frame and thus stop pushing against the mattress support frame after the wheel frame has reached a partially unfolded position. After the leverage member has stopped rotating, it provides a simple mechanical link between the lift actuator and the wheel frame. Since the wheel frame is partially unfolded, the lift actuator has tilted sufficiently from its initial generally horizontal position to provide a sufficient amount of vertical force for powering the further unfolding of the wheel frame. As the lift actuator continues extending, the wheel frame unfolds to a fully unfolded position. Accordingly, in this embodiment of the present invention, a low profile bed is provided which can be folded into a flat configuration for providing a very low mattress elevation and yet which can be raised by lift actuators to provide a fully elevated bed.

DETAILED DESCRIPTION OF THE PREFERRED EMBODIMENT

Figure 1:
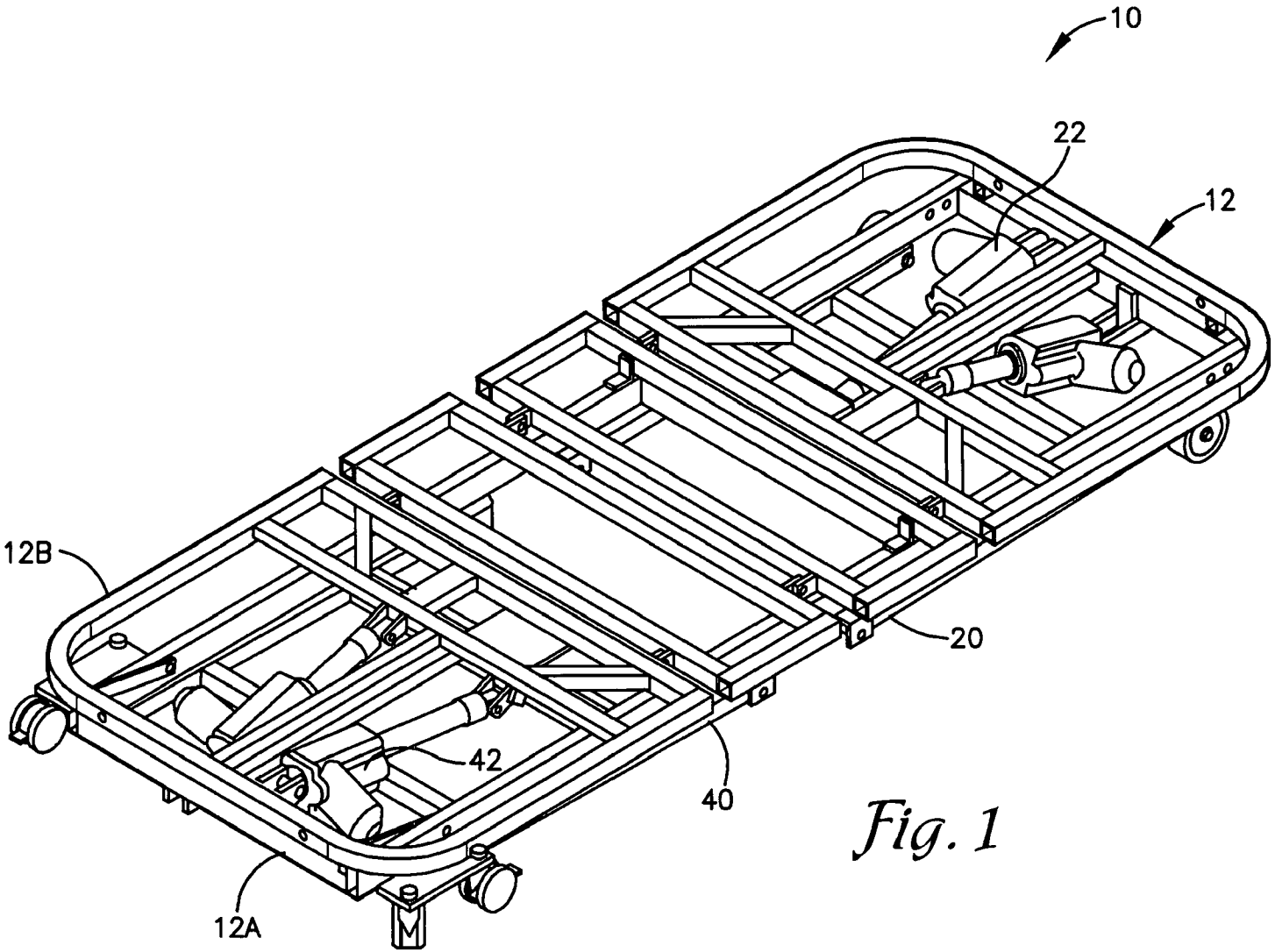
FIG. 1 is a top perspective view of the low profile hospital bed in the folded position.
Figure 2:
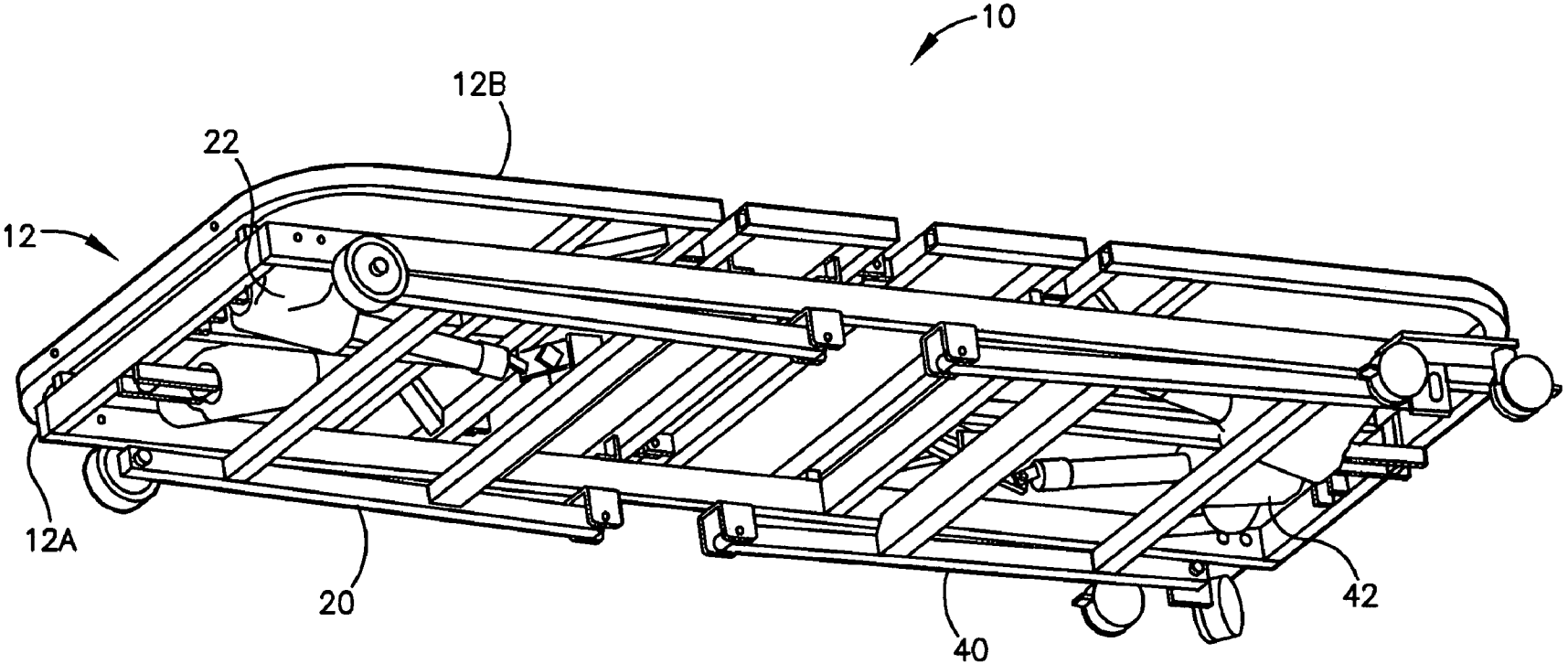
FIG. 2 is a bottom perspective view of the low profile hospital bed in the folded position.
Figure 3:
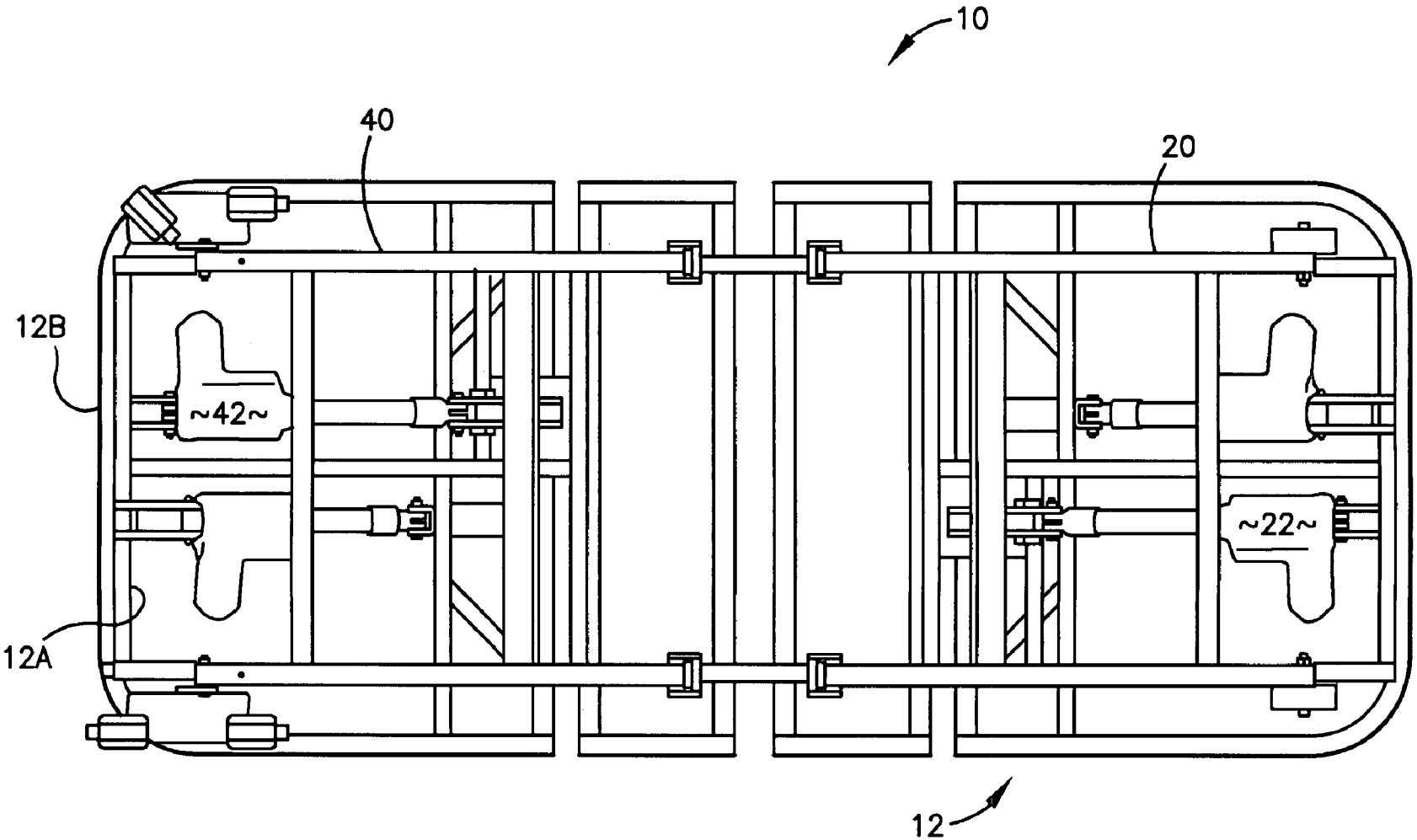
FIG. 3 is a bottom view of the low profile hospital bed in the folded position.
Figure 4:
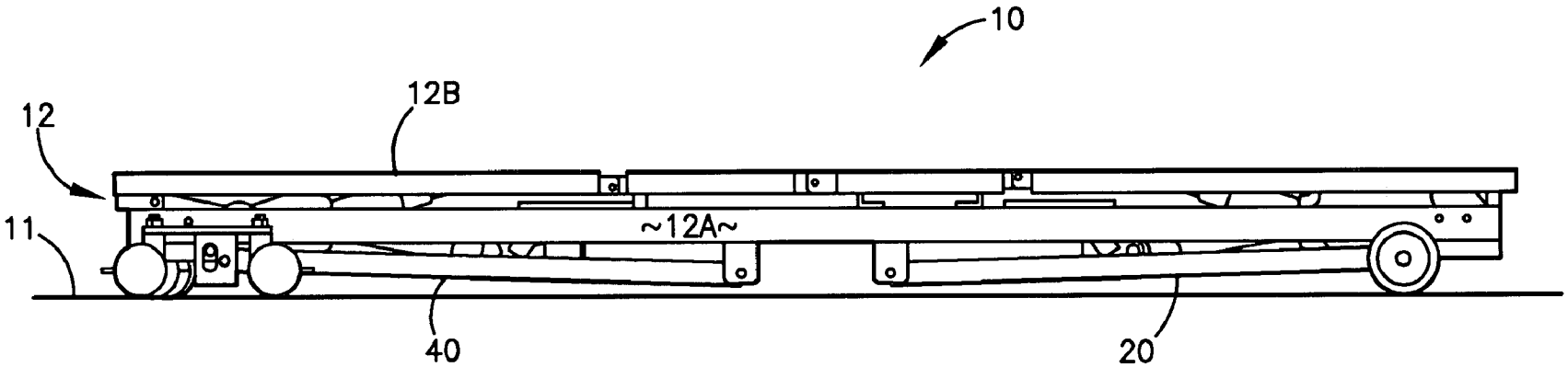
FIG. 4 is a side view of the low profile hospital bed in the folded position.

Referring to the drawings, FIGS. 1-18 show a low profile hospital bed 10 in accordance with an embodiment of the present invention. As can be seen in the referenced figures, hospital bed 10 includes a mattress support frame 12 and opposite wheel frames 20 and 40 pivotably mounted to mattress support frame 12. Wheel frames 20 and 40 carry wheels which are shown to be in contact with floor 11 in FIGS. 4, 5A, 5B, 7, 8, 10A, 11, 14 and 17. Mattress support frame 12 includes a rigid portion 12A and an articulated portion 12B for arranging the relative angles of the various portions of a supported mattress as is well known in the art. A pair of lift actuators 22 and 42 connect between opposite ends of the rigid portion 12A of mattress support frame 12 and leverage members 26 and 46 mounted to wheel frames 20 and 40.

Figure 9:
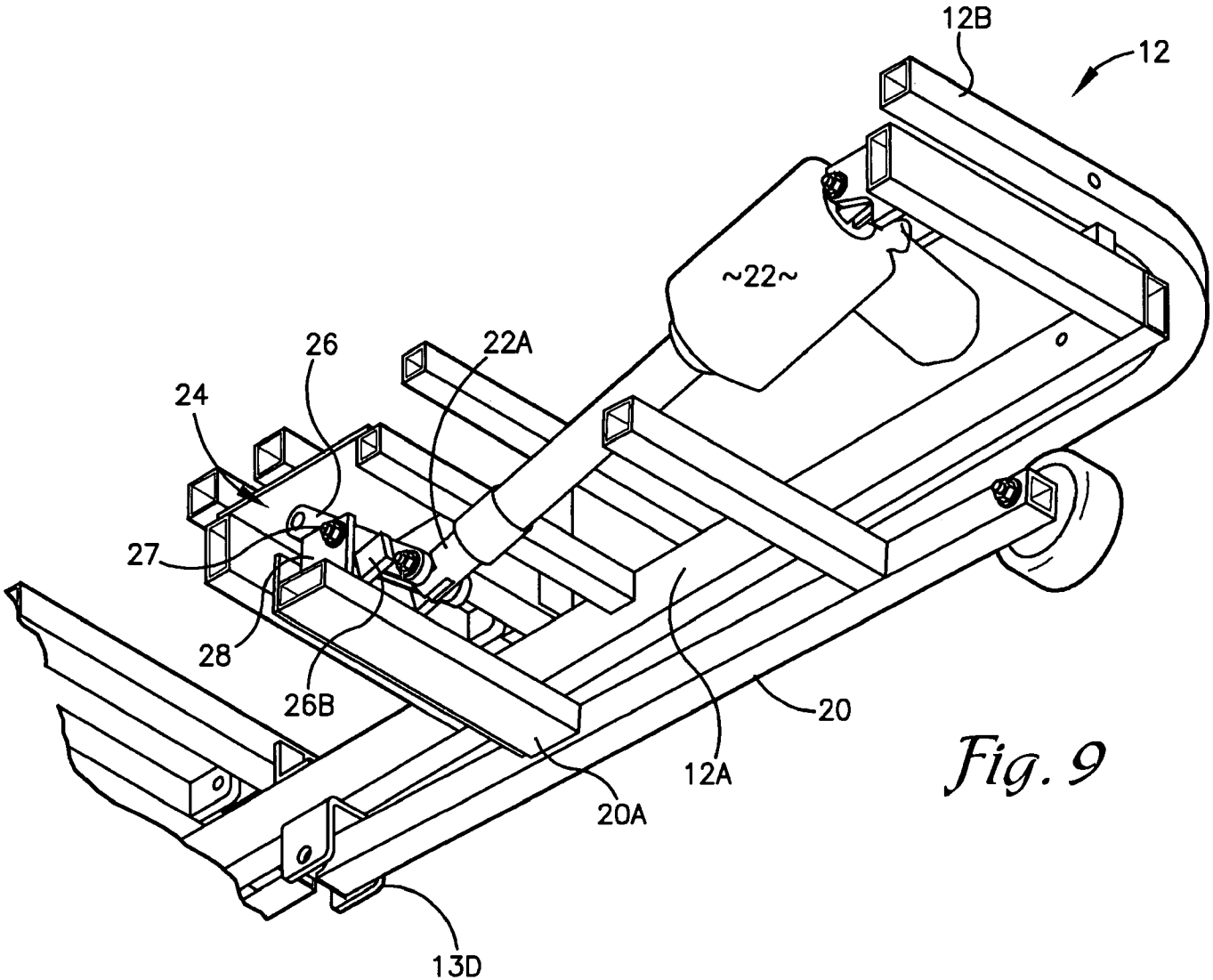
FIG. 9 is a magnified partial bottom perspective view of the hospital bed in a partially unfolded position.
Figure 10:
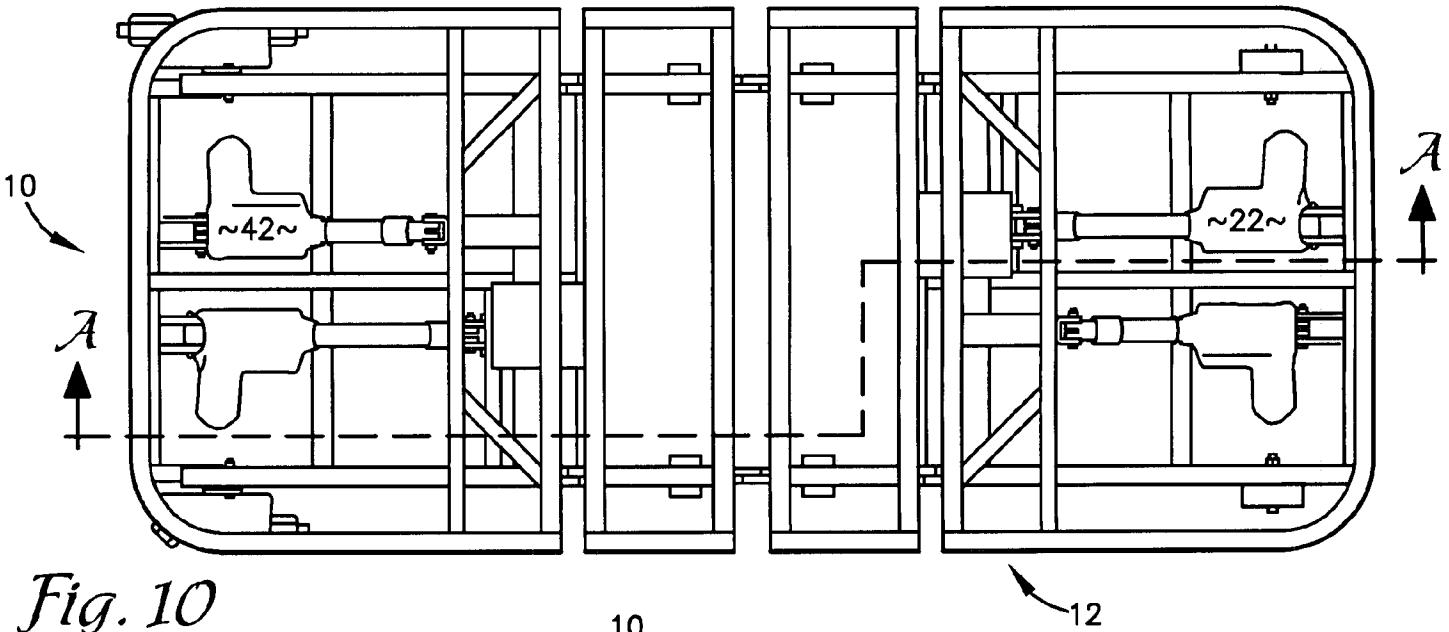
FIG. 10 is a top view of the low profile hospital bed in a partially unfolded.
Figure 10A:
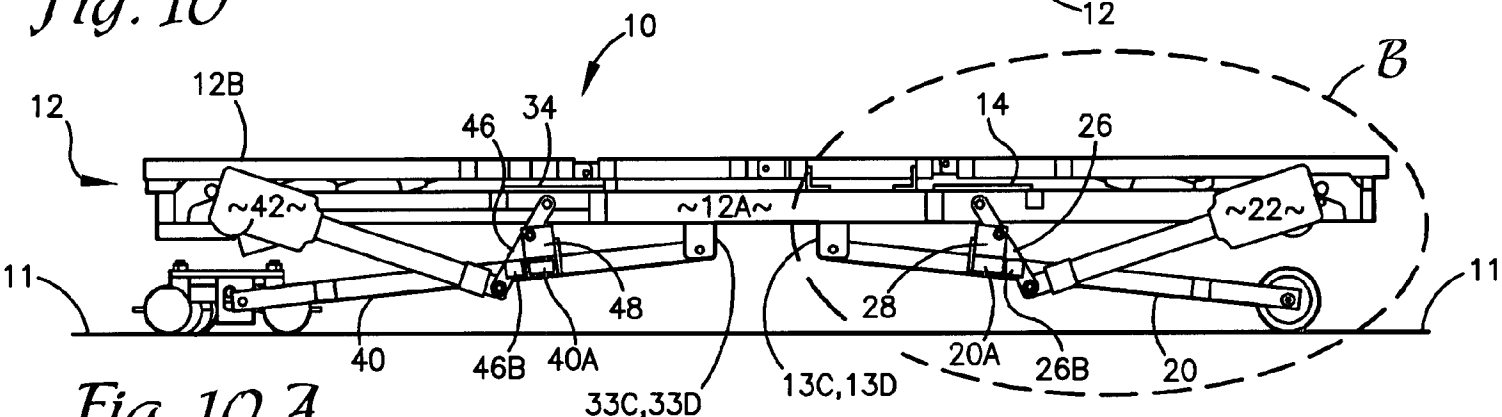
FIG. 10A is a cross sectional side view of the low profile hospital bed taken from plane A-A of FIG. 11 in a partially unfolded position.

Low profile hospital bed 10 employs lift actuators in a mechanism which operates in two stages to pivot each of opposite wheel frames 20 and 40 from a folded position as shown in FIGS. 1-6 to a fully unfolded position as shown in FIGS. 14-18. During the first stage of motion, opposite leverage assemblies 24 and 44 operate to urge wheel frames 20 and 40 away from mattress support frame 12. During this first stage, lift actuators 22 and 42 rotate a pair of relatively short leverage members 26 and 46 which are pivotably mounted to wheel frames 20 and 40 respectively. As leverage members 26 and 46 rotate, they urge wheel frames 20 and 40 away from mattress support frame 12. Thus, during the first stage of motion, each wheel frame 20 and 40 pivots from the first folded position shown in FIGS. 1-6 to an intermediate partially unfolded position shown in FIGS. 7-9 and finally to a partially unfolded position shown in FIGS. 10A-13. At the end of the first stage of motion, wheel frames 20 and 40 are in the partially unfolded position shown in FIGS. 10A-13. As can be seen in FIG. 10A, leverage members 26 and 46 have pivoted to the end of their ranges of motion as stop blocks 26B and 46B fixed respectively to leverage members 26 and 46 engage cross members 20A and 40A of wheel frames 20 and 40. Once these components have translated to the positions shown in FIG. 10A, leverage members 26 and 46 function as simple mechanical links between the lift actuators and the wheel frames and lift actuators 26 and 46 are tilted sufficiently from horizontal such that they can apply enough vertical force to power the complete extension of wheel frames 20 and 40. FIGS. 14-18 show low profile hospital bed 10 or portions of it when it is in a fully extended and fully raised position.

Accordingly, during the first stage of motion described above, lift actuators 22 and 42 cause the rotation of leverage members 26 and 46 relative to wheel frames 20 and 40 in order to pry wheel frames 20 and 40 away from mattress support frame 12. During the second stage of motion, leverage members 26 and 46 are locked from continued rotation such that lift actuators 22 and 42 cause relative motion between mattress support frame 12 and leverage members 26 and 46 and thus further rotation of wheel frames 20 and 40 to which they are attached.

As noted above, the movement of wheel frames 20 and 40 between the folded position to the end of the first stage of motion is accomplished by the rotation of leverage members 26 and 46. Leverage members 26 and 46 are subcomponents of leverage assemblies 24 and 44 which connect between wheel frames 20 and 40 respectively and rigid frame 12A of mattress support frame 12. Because wheel frames leverage assemblies 24 and 44 are preferably symmetrical and identical assemblies, for the sake of clarity and simplicity, it is possible to discuss the detailed structure and function of one wheel frame and its associated leverage assembly. For the purposes of this detailed description, wheel frame 20 and leverage assembly 24 will be described. It should also be understood by the skilled reader that the movements of these generally symmetrical components preferably occur in a substantially symmetrical and synchronized manner so that mattress support frame 12 raises up in a uniform and level fashion.

Figure 5:
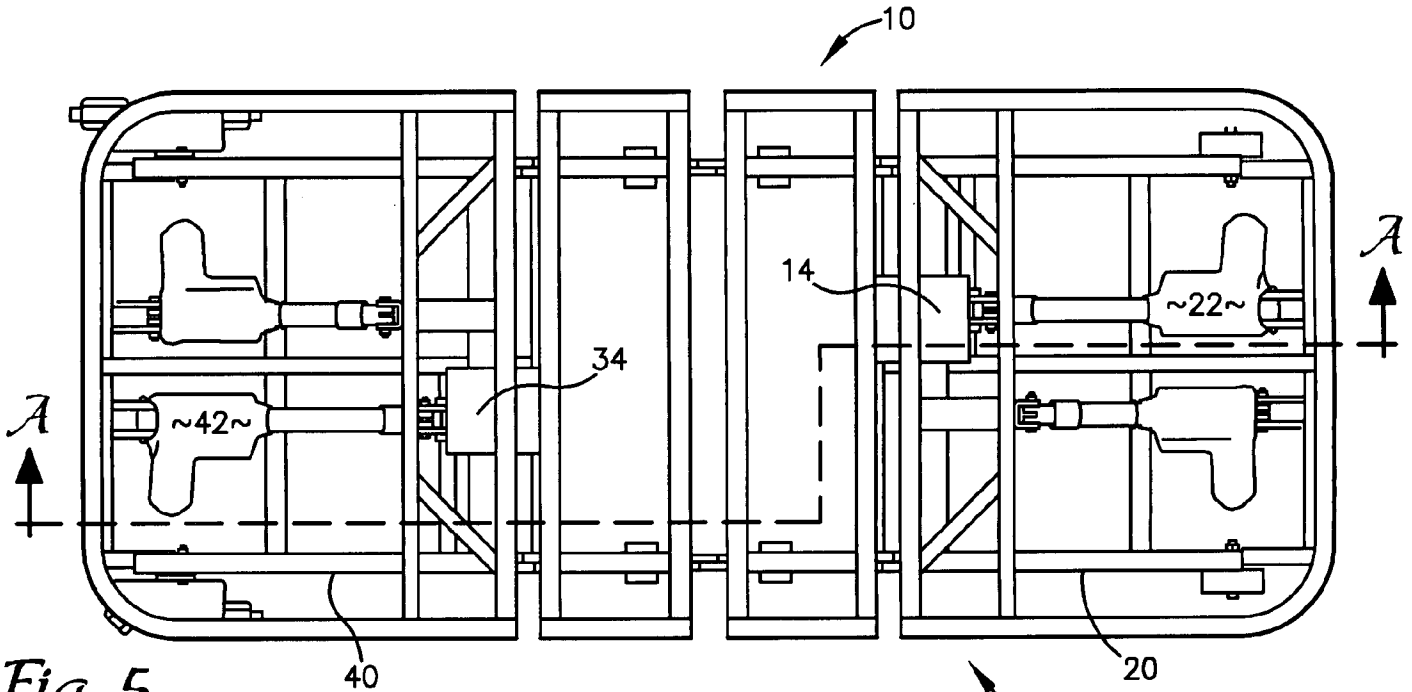
FIG. 5 is a top view of the low profile hospital bed in the folded position.
Figure 5A:
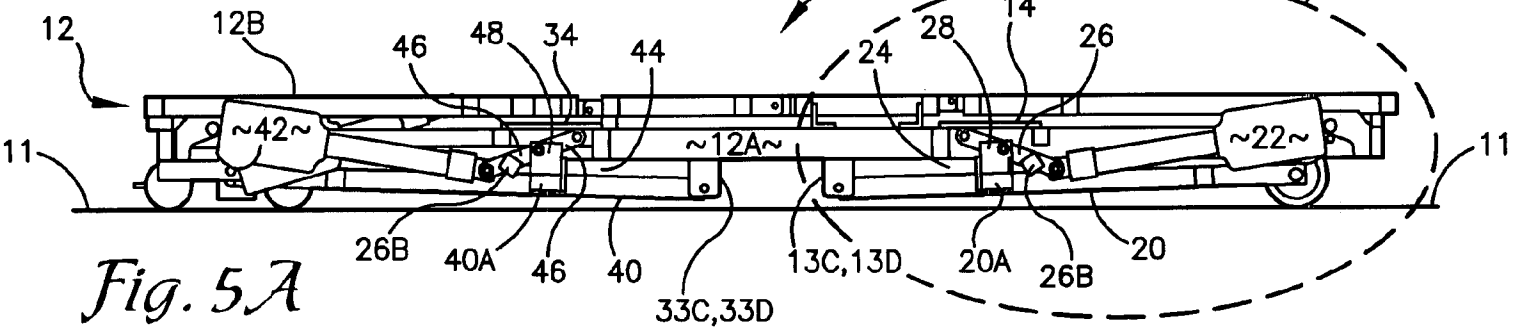
FIG. 5A is a cross sectional side view of the low profile hospital bed in the folded position taken from plane A-A of FIG. 5.
Figure 5B:
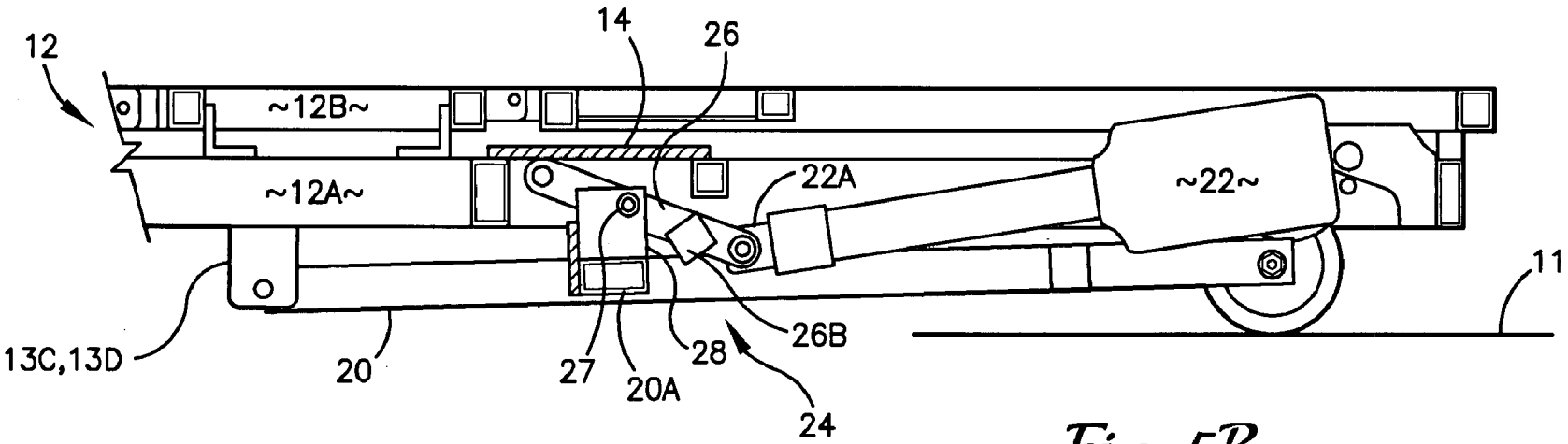
FIG. 5B is a magnified cross sectional side view of the right hand portion the low profile hospital bed taken from portion B of FIG. 5A.

The purpose of leverage assembly 24 is to accomplish the first stage of motion in which leverage member 26 pries wheel frame 20 away from mattress support frame 12 thus lifting mattress support frame 12 from the position shown in FIG. 5A to the position shown in FIG. 10A. Leverage assembly 24 is illustrated in FIG. 5A and FIG. 5B. FIG. 5B is an enlarged view of portion B indicated in FIG. 5A. As is shown in FIG. 5B, leverage assembly 24 includes leverage member 26 which is pivotably mounted at a fulcrum 27 to a clevis bracket 28 fixed to a cross member 20A of wheel frame 20. As can be seen in FIG. 5B, wheel frame 20 is in turn pivotably mounted by opposite devises 13C and 13D to rigid frame 12A of mattress support frame 12. As can be best seen in FIG. 16, leverage member 26 includes a clevis portion at its first end for connecting with the distal end of an actuator rod 22A. As can also be best seen in FIG. 15, leverage member 26 includes a roller 26A mounted within a second clevis portion at its opposite second end. Fixed to the side of leverage member 26 is a pair of stop blocks 26B. The function of stop blocks 26B will be described in greater detail below. A roller track member 14 for engaging roller 26A is mounted to rigid portion 12A of mattress support frame 12.

Figure 6:
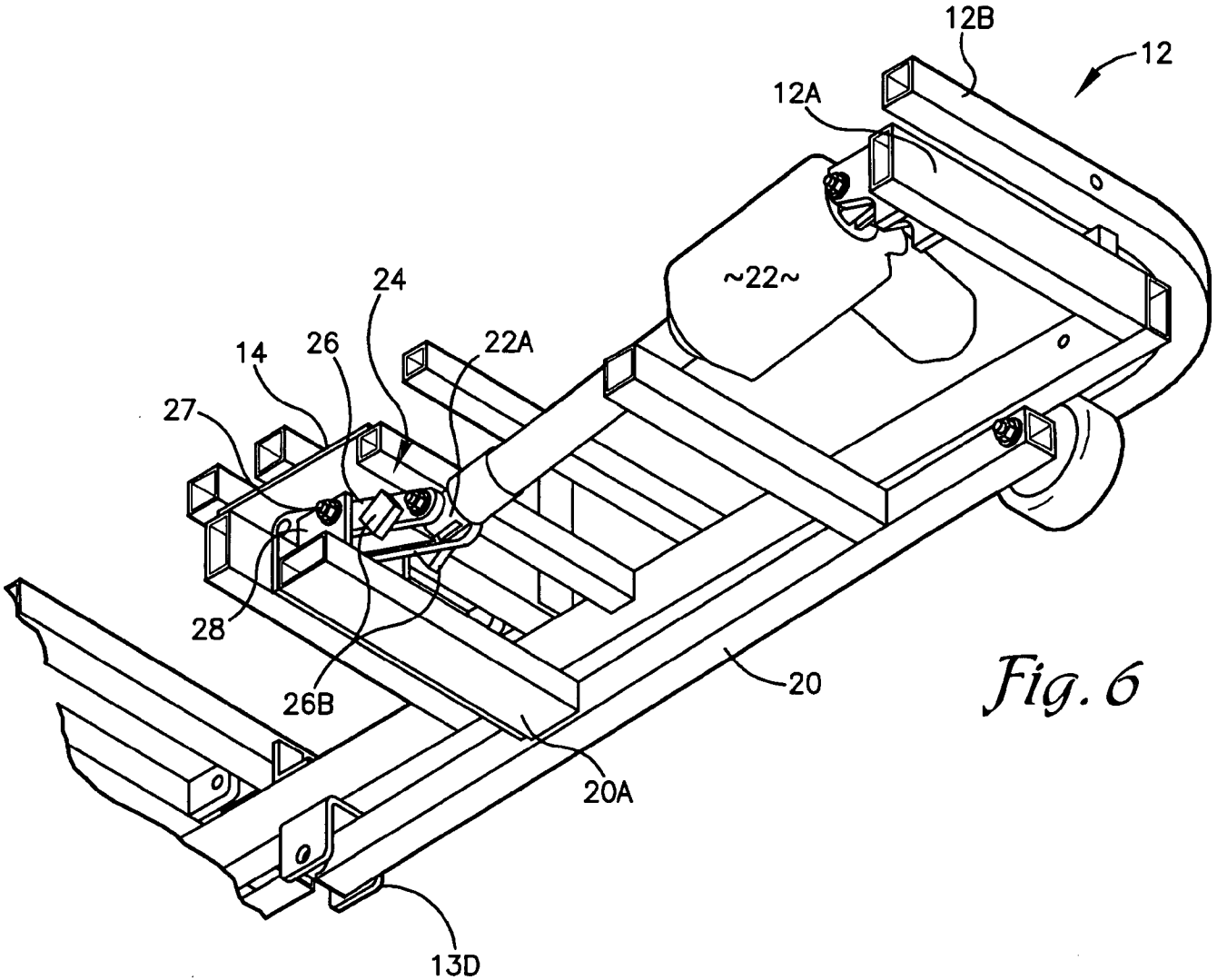
FIG. 6 is a magnified partial bottom perspective view of the right hand portion the low profile hospital bed in the folded position.
Figure 7:
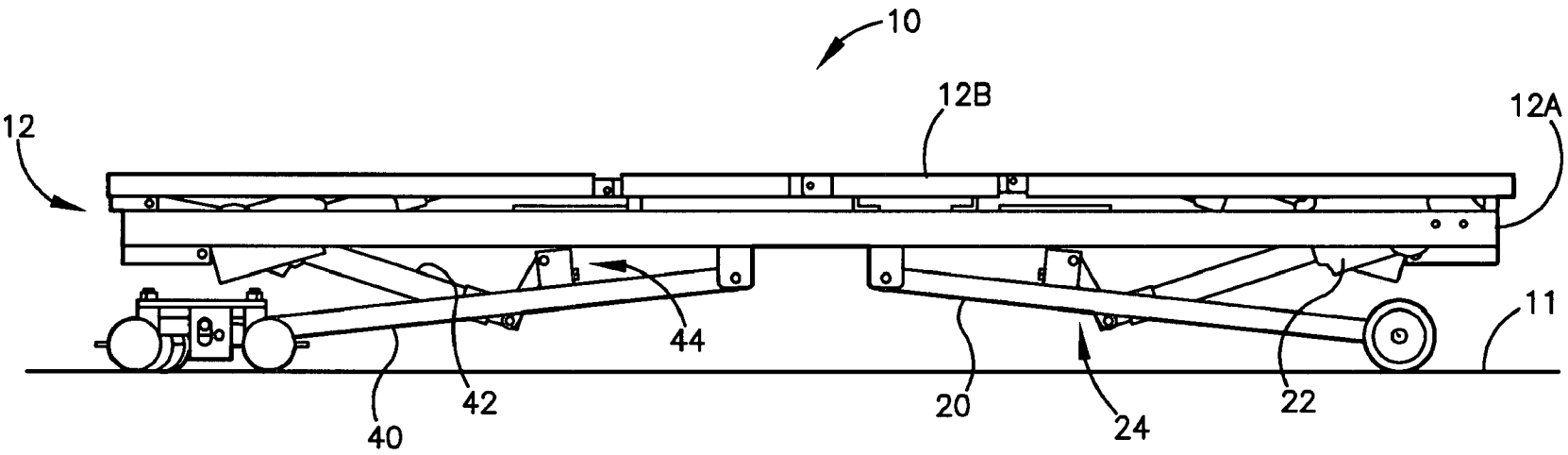
FIG. 7 is a side view of the right side of the low profile hospital bed in a partially unfolded position.
Figure 8:
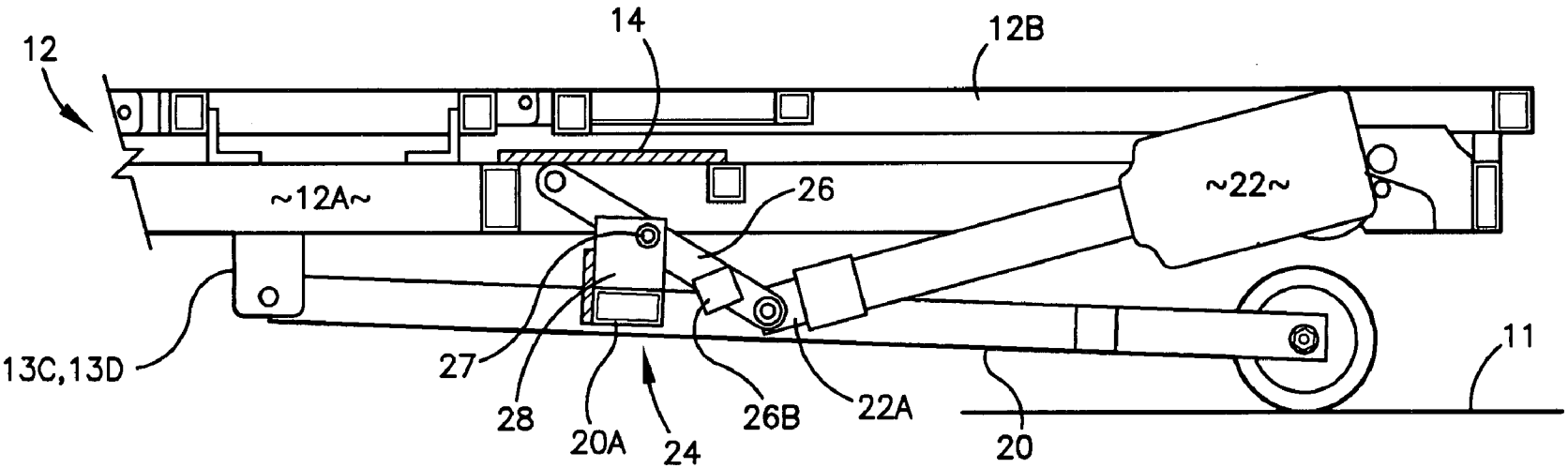
FIG. 8 is a magnified partial cross sectioned side view of the low profile hospital bed in a partially unfolded position.
Figure 11:
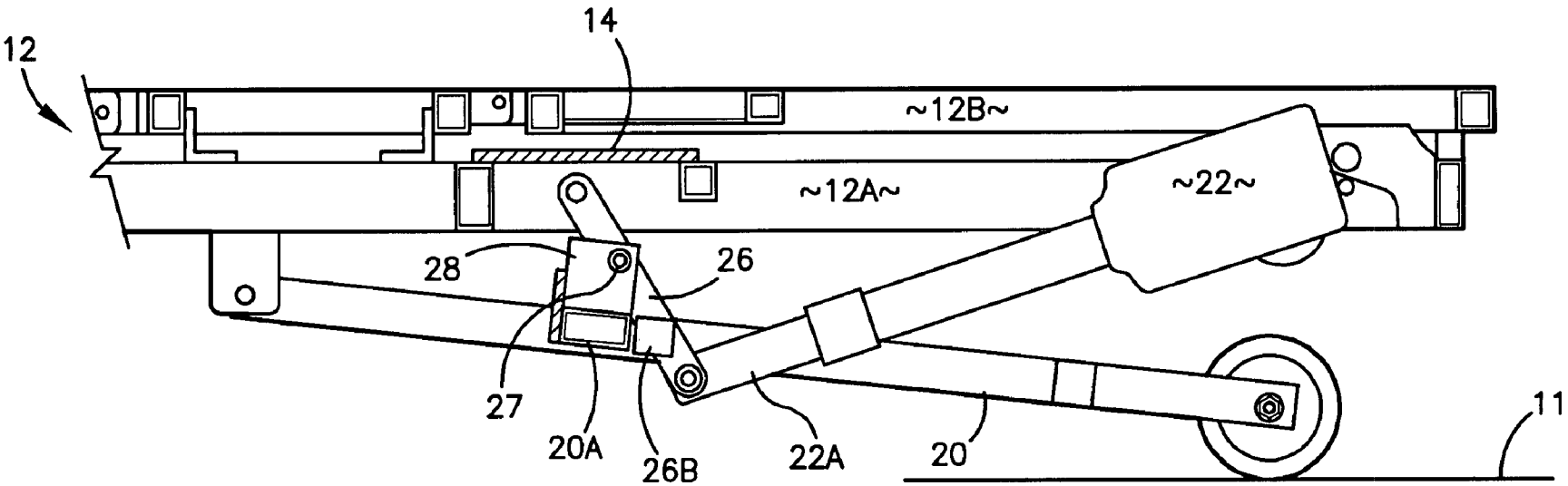
FIG. 11 is a magnified cross sectional side view of the right hand portion the low profile hospital bed in a partially unfolded position taken from portion B of FIG. 10A.
Figure 12:
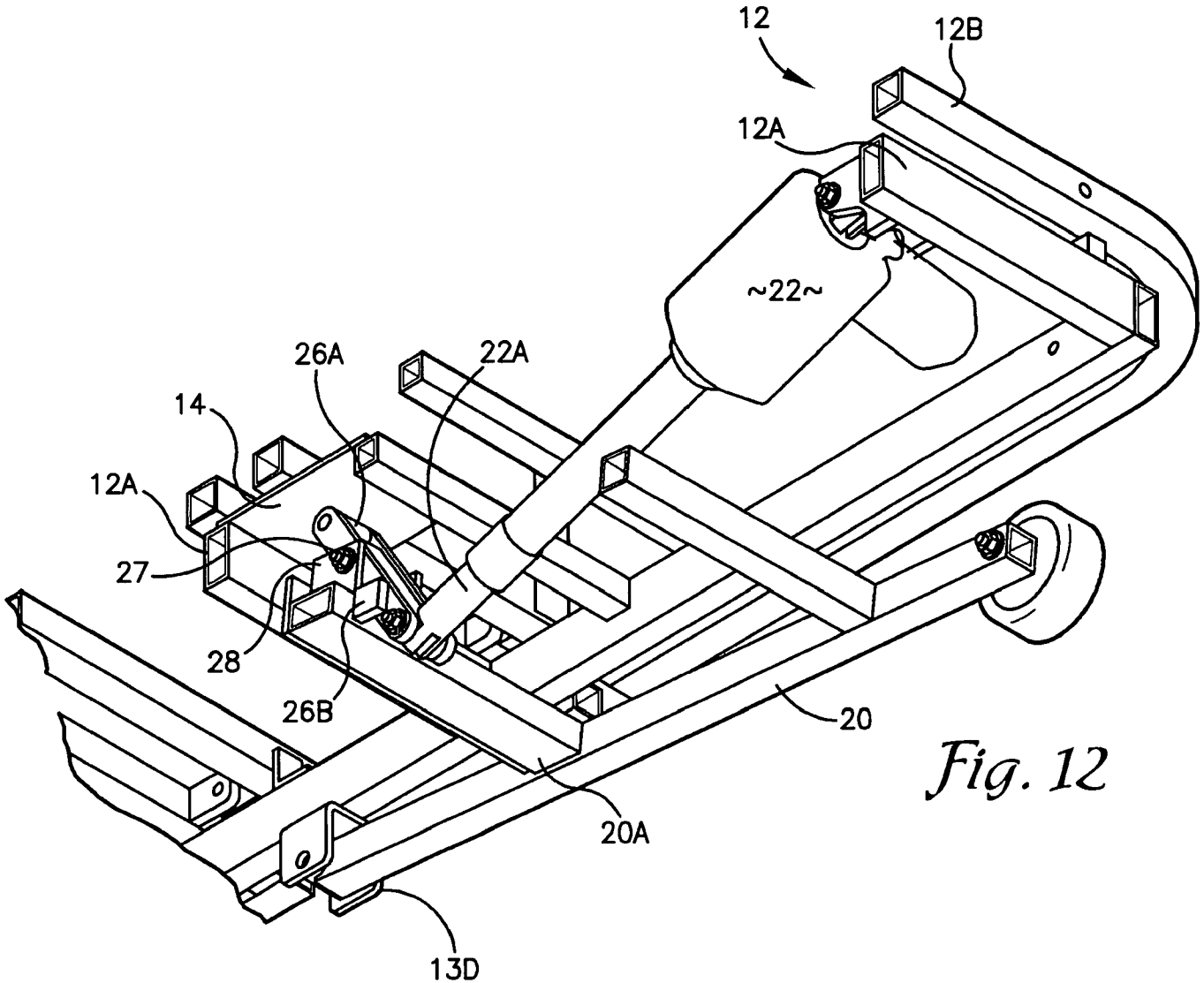
FIG. 12 is a magnified partial bottom perspective view of the right hand portion the low profile hospital bed in a partially unfolded position.
Figure 13:
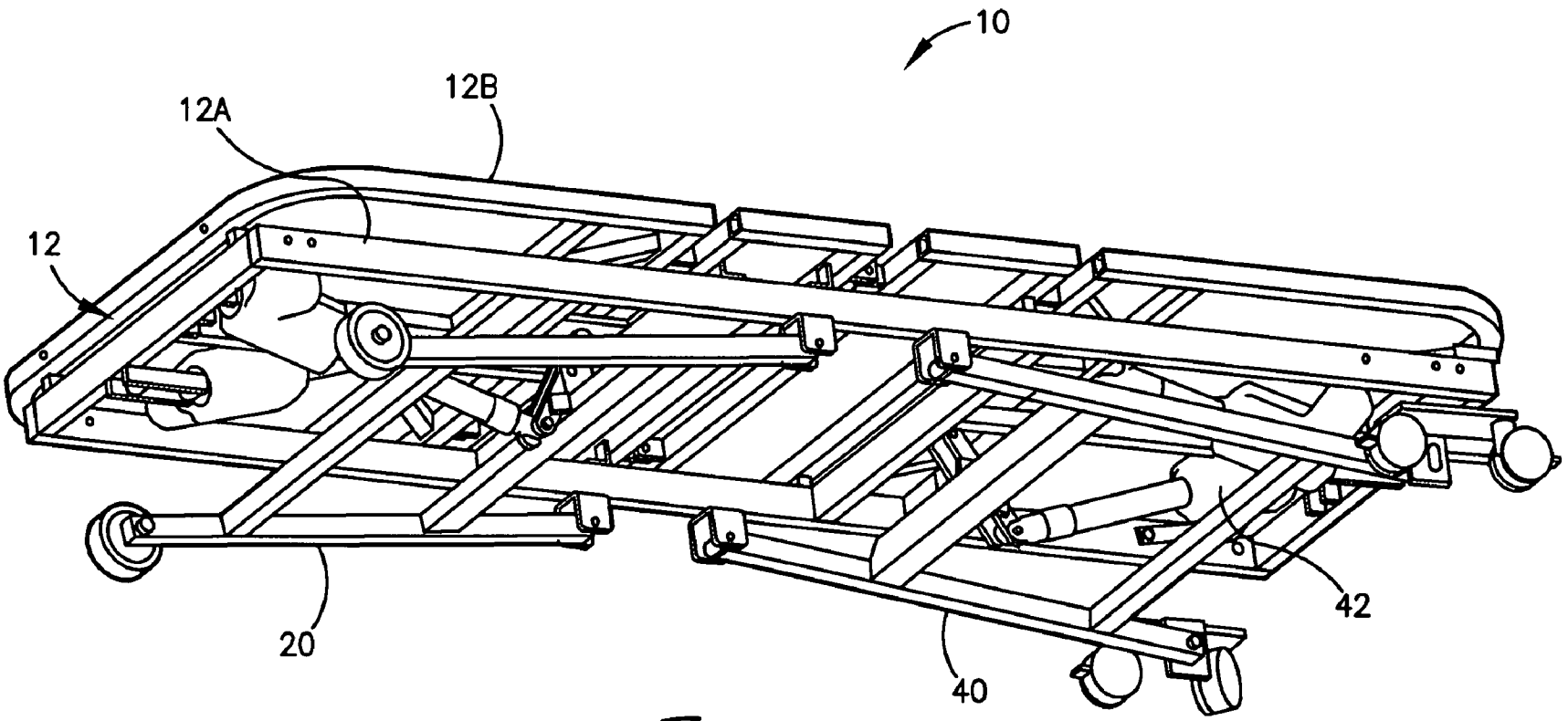
FIG. 13 is a bottom perspective full view the low profile hospital bed in a partially unfolded position.
Figure 14:
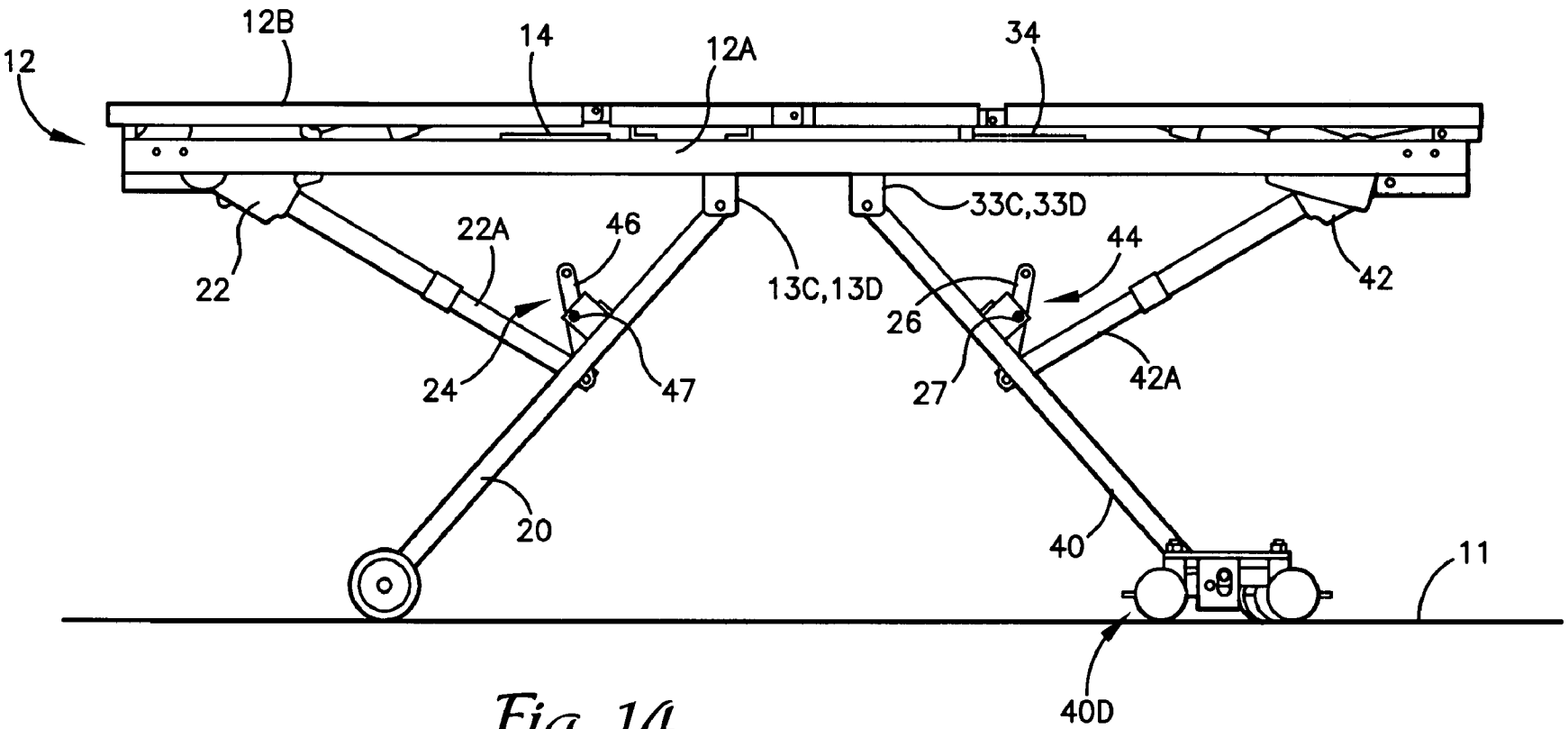
FIG. 14 is a side view of the low profile hospital bed in a fully unfolded position.
Figure 15:
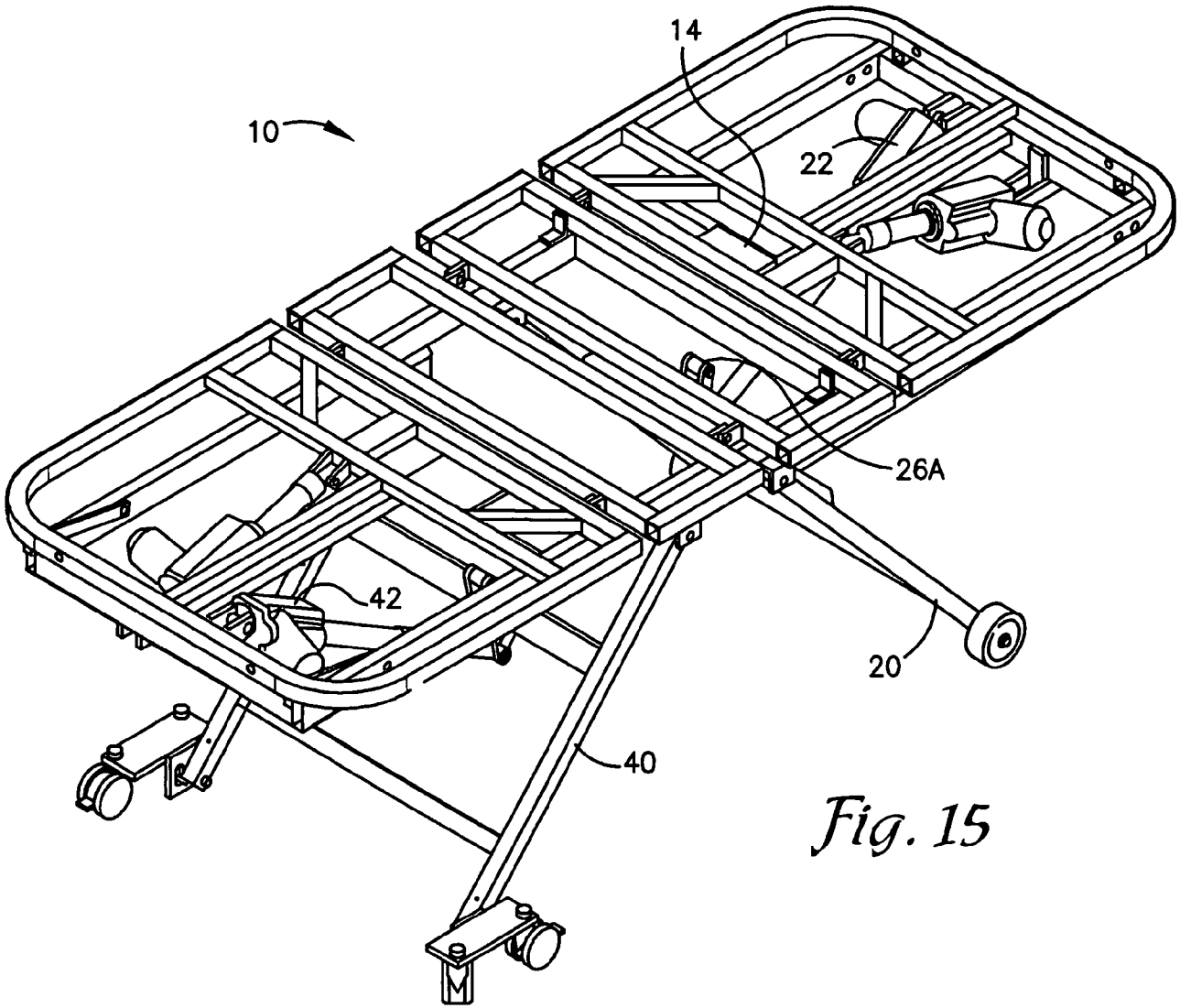
FIG. 15 is top perspective view of the low profile hospital bed in the fully unfolded position.

The motion of the first stage may be understood by comparing FIGS. 5B, 8 and 11. In FIGS. 5A-6, leverage assembly 24 is positioned at the beginning of the first stage. In FIGS. 5A-6, leverage member 26 is oriented such that roller 26A is in contact with roller track member 14 but may be envisioned as not applying significant force to roller track member 14. In FIGS. 5A-6, actuator rod 22A is completely retracted and wheel frame 20 is in a folded position thus allowing a very low profile for low profile bed 10. FIGS. 7-9 show leverage assembly 24 after lift actuator 22 has rotated leverage member 26 clockwise approximately 20° with respect to clevis bracket 28. When leverage assembly 24 is in this position, actuator rod 22A of lift actuator 22 is slightly extended, roller 26A has moved along roller track member 14 and is applying a significant force upon roller track member 14, stop block 26B is approaching its contact position with cross member 20A and most importantly, wheel frame 20 has been pried away from its folded position to a slightly unfolded position. During this stage of motion, the prying action of leverage member 26 against roller track member 14 amplifies the otherwise insufficient vertical force component of the nearly horizontal lift actuator 22 to provide a vertical force sufficient to pivot wheel frames 20 away from mattress support frame 12 thus lifting mattress support frame 20.

FIGS. 10-13 show low profile bed 10 and more particularly leverage assembly 24 at the end of the first stage of motion and at the beginning of the second stage of motion. In FIGS. 10-13, stop blocks 26B are in contact with cross member 20A of wheel frame 20. In FIGS. 10-13, leverage member 26 can be envisioned as having rotated from a first position shown in FIG. 5B to a second position shown in FIG. 11. Because stop block 26B interferes with cross member 20A of wheel frame 20 when leverage member reaches the second position shown in FIG. 11, leverage member 26 can not rotate past the second position shown in FIG. 11. When leverage member 26 is in the second position shown in FIG. 11, the force applied by roller 26A to roller track member 14 shifts to stop blocks 26B as leverage member 26 is locked from further rotation away from the first position relative to leg assembly 20. Note that leverage member 26 is locked from further rotation before it reaches a top dead center position in which leverage member 26 would be generally normal to wheel frame 20 or generally normal to roller track member 14. This allows for continuous and smooth motion as wheel frame 20 is unfolding and when wheel frame 20 is folding to return to the position shown in FIGS. 1-6. After leverage member 26 is locked by contact between stop block 26B and cross member 20A, lift actuator 22 continues extending as wheel frame 20, in the second stage movement, extends into the fully unfolded position shown in FIGS. 14-18.

Figure 16:
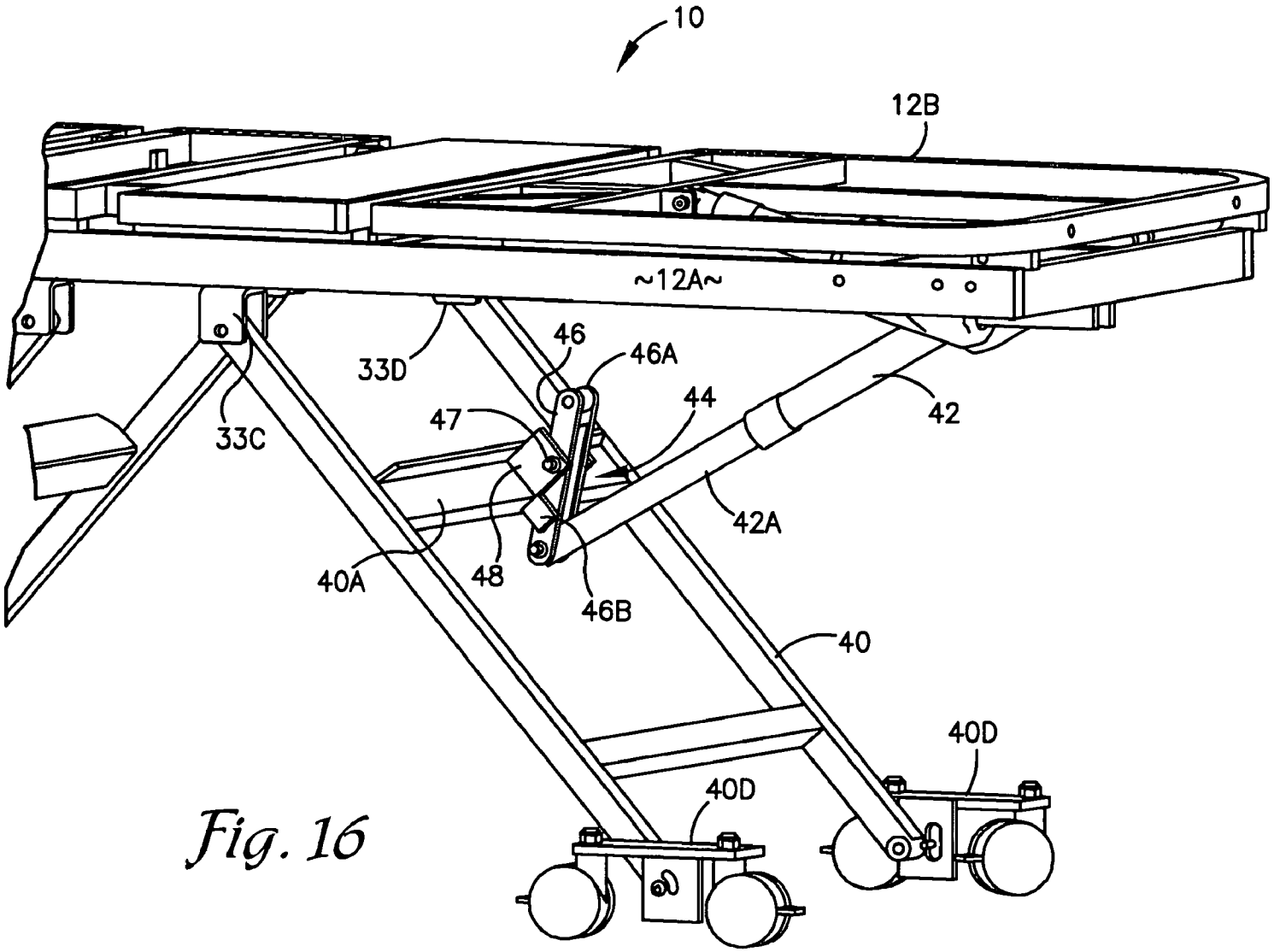
FIG. 16 is a partial perspective view of the low profile hospital bed in the fully unfolded position.
Figure 17:
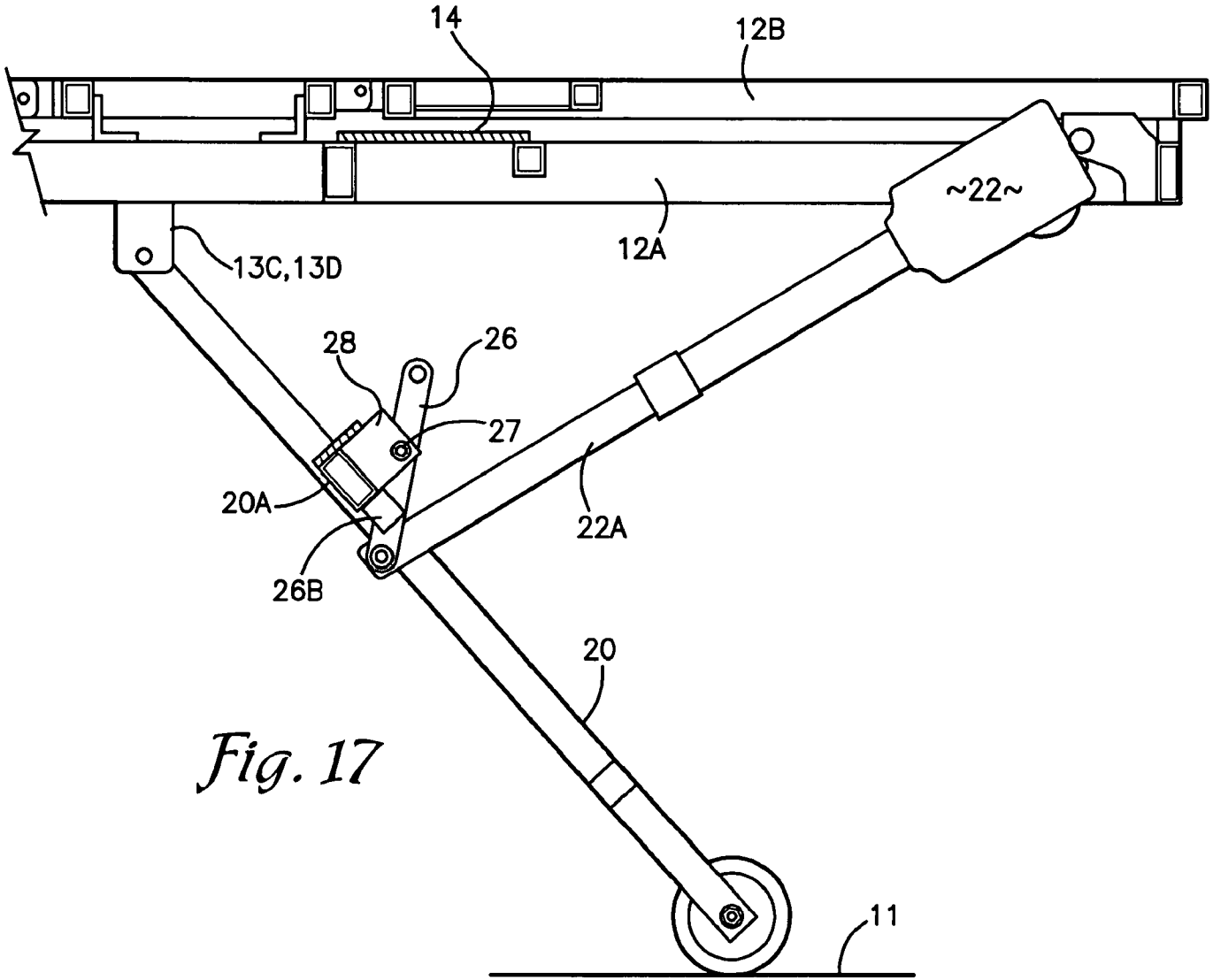
FIG. 17 is a partial side view of the low profile hospital bed in the fully unfolded position.

FIG. 16 provides a perspective view of the opposite end of low profile hospital bed 10. As can be seen in FIG. 16, the components described above are mirrored by generally opposite, symmetrical components and are given reference numbers which are twenty greater than those given to the components described above. Accordingly, lift actuator 42 and leverage assembly 44 associate between rigid frame portion 12A and wheel frame 40. Leverage assembly 44 includes a leverage member 46 having a roller 46A and a stop block 46B. Leverage member 46 is pivotably mounted to a cross member 40A by a clevis bracket 48. Wheel frame 40 is pivotably mounted to rigid portion 12A of mattress support frame 12 by a pair of clevis brackets 33C and 33D.

Accordingly, low profile hospital bed 10 described above solves the above stated problem by providing an extremely low profile bed which can raise itself and a patient to an elevation which is easily accessible for doctors and nurses attending the patient. When in the lowered position, low profile hospital bed 10 provides a safe support for a patient who is susceptible to rolling or falling out of bed.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A bed comprising:

a mattress support frame for supporting a mattress;

a wheel frame movably coupled with the mattress support frame to allow for movement of the mattress support frame between a fully lowered position and a fully raised position relative to the wheel frame;

a leverage member movably mounted between the mattress support frame and the wheel frame; and a lift actuator operable to retract and extend, with the lift actuator and the leverage member being arranged such that an initial extension of the lift actuator causes the leverage member to urge the mattress support frame away from the wheel frame until the mattress support frame moves from the fully lowered position to a partially raised position, and such that a subsequent extension of the lift actuator causes the mattress support frame to move from the partially raised position to the fully raised position relative to the wheel frame, wherein the leverage member includes a first end and a second end, and the leverage member is pivotably mounted between the mattress support frame and the wheel frame about a fulcrum located between the first end and the second end, and the lift actuator is pivotably coupled with the second end of the leverage member.

2. The bed as set forth in claim 1, wherein the mattress support frame includes a substantially rigid portion and an articulated portion.

3. The bed as set forth in claim 1, wherein the fully lowered position conesponds to a fully folded configuration of the bed, and wherein the fully raised position conesponds to a fully unfolded configuration of the bed.

4. The bed as set forth in claim 1, wherein the leverage member further includes a roller movably coupled with the first end of the leverage member to facilitate urging the mattress support frame away from the wheel frame.

5. The bed as set forth in claim 4, wherein the lift actuator is pivotably coupled with the mattress support frame, the fulcrum is associated with the wheel frame, and the roller pushes against the mattress support frame in order to urge the mattress support frame away from the wheel frame.

6. The bed as set forth in claim 1, wherein there are at least two wheel frames movably coupled with the mattress support frame.

7. The bed as set forth in claim 6, wherein there are at least two leverage members and two lift actuators, with each of the at least two wheel frames being associated with a respective one of the at least two leverage members and a respective one of the at least two lift actuators.

8. A low profile hospital bed comprising:

a mattress support frame for supporting a mattress;

a wheel frame movably coupled with the mattress support frame to allow for movement of the mattress support frame between a fully lowered position and a fully raised position relative to the wheel frame;

a leverage member having a first end and a second end, with a roller being movably coupled with the first end, and with the leverage member being pivotably mounted between the mattress support frame and the wheel frame about a fulcrum located between the first end and the second end; and a lift actuator operable to retract and extend, with the lift actuator and the leverage member being arranged such that an initial extension of the lift actuator causes the leverage member to urge the mattress support frame away from the wheel frame until the mattress support frame moves from the fully lowered position to a partially raised position, and such that a subsequent extension of the lift actuator causes the mattress support frame to move from the partially raised position to the fully raised position relative to the wheel frame.

9. The low profile hospital bed as set forth in claim 8, wherein the mattress support frame includes a substantially rigid portion and an articulated portion.

10. The low profile hospital bed as set forth in claim 8, wherein the fully lowered position conesponds to a fully folded configuration of the bed, and wherein the fully raised position corresponds to a fully unfolded configuration of the bed.

11. The low profile hospital bed as set forth in claim 8, wherein the lift actuator is pivotably coupled with the mattress support frame, the fulcrum is associated with the wheel frame, and the roller pushes against the mattress support frame in order to urge the mattress support frame away from the wheel frame.

12. The low profile hospital bed as set forth in claim 8, wherein there are at least two wheel frames movably coupled with the mattress support frame.

13. The low profile hospital bed as set forth in claim 12, wherein there are at least two leverage members and two lift actuators, with each of the at least two wheel frames being associated with a respective one of the at least two leverage members and a respective one of the at least two lift actuators.

14. The low profile hospital bed as set forth in claim 8, further including a stop block, wherein the leverage member is allowed to move between a first position, in which the mattress support frame is in the fully lowered position, and a second position, in which the mattress support frame is in the partially raised position, and the stop block prevents further movement of the leverage member while the mattress support frame moves from the partially raised position to the fully raised position relative to the wheel frame.

15. A low profile hospital bed comprising:

a mattress support frame for supporting a mattress;

at least two wheel frames, with each of the at least two wheel frames being movably coupled with the mattress support frame to allow for movement of the mattress frame between a fully raised position, which corresponds to a fully folded configuration of the low profile hospital bed, and a fully raised position, which corresponds to a fully unfolded configuration of the low profile hospital bed, relative to the at least two wheel frames;

at least two leverage members, with each of the at least two leverage members being associated with a respective one of the at least two wheel frames, and with each of the at least two leverage members having a first end and a second end with a roller being movably coupled with the first end, and with each of the at least two leverage members being pivotably mounted between the mattress support frame and the respective one of the at least two wheel frames about a fulcrum located between the first end and the second end; and at least two lift actuators, with each of the at least two lift actuators being associated with a respective one of the at least two wheel frames, and with each of the at least two lift actuators being operable to retract and extend and to cooperate with a respective one of the at least two leverage members such that extension of each of the at least two lift actuators causes the respective one of the at least two leverage members to urge the mattress support frame away from the respective one of the at least two wheel frames until the mattress support frame moves from the fully lowered position to a partially raised position and such that a subsequent extension of each of the at least two lift actuators causes the mattress support frame to move from the partially raised position to the fully raised position relative to the respective one of the at least two wheel frames.

16. The low profile hospital bed as set forth in claim 15, wherein the mattress support frame includes a substantially rigid portion and an articulated portion.

17. The low profile hospital bed as set forth in claim 15, wherein each of the at least two lift actuators is pivotably coupled with the mattress support frame, each fulcrum is associated with the respective one of the at least two wheel frames, and each roller pushes against the mattress support frame in order to urge the mattress support frame away from the respective one of the at least two wheel frames.

18. The low profile hospital bed as set forth in claim 15, further including at least two stop blocks, with each of the at least two stop blocks being associated with a respective one of the at least two leverage members such that each of the at least two leverage arms is allowed to move between a first position, in which the mattress support frame is in the fully lowered position, and a second position, in which the mattress support frame is in the partially raised folded position, and each of the at least two stop blocks prevents further movement of the respective one of the at least two leverage members while the mattress support frame moves from the partially raised position to the fully raised position relative to the respective one of the at least two wheel frames.

19. A bed comprising:

a mattress support frame for supporting a mattress;

a wheel frame movably coupled with the mattress support frame to allow for movement of the mattress support frame between a fully lowered position and a fully raised position relative to the wheel frame;

a leverage member movably mounted between the mattress support frame and the wheel frame;

a lift actuator operable to retract and extend, with the lift actuator and the leverage member being arranged such that an initial extension of the lift actuator causes the leverage member to urge the mattress support frame away from the wheel frame until the mattress support frame moves from the fully lowered position to a partially raised position, and such that a subsequent extension of the lift actuator causes the mattress support frame to move from the partially raised position to the fully raised position relative to the wheel frame; and a stop block, wherein the leverage member is allowed to move between a first position, in which the mattress support frame is in the fully lowered position, and a second position, in which the mattress support frame is in the partially raised position, and the stop block prevents further movement of the leverage member while the mattress support frame moves from the partially raised position to the fully raised position relative to the wheel frame.

* * * * *

UNITED STATES PATENT AND TRADEMARK OFFICE

CERTIFICATE OF CORRECTION

PATENT NO. : 7,334,277 B2
APPLICATION NO. : 11/351459
DATED : February 26, 2008
INVENTOR(S) : Michael Karl Johnson It is certified that error appears in the above-identified patent and that said Letters Patent is hereby corrected as shown below:

Column 6, line 2, the word “conesponds” should be changed to -- corresponds --.

Column 6, line 3, the word “conesponds” should be changed to -- corresponds --.

Column 6, line 48, the word “conesponds” should be changed to -- corresponds --.

Signed and Sealed this

Eighth Day of July, 2008

JON W. DUDAS
*Director of the United States Patent and Trademark Office*